US005244313A

United States Patent [19]

Pallini et al.

[11] Patent Number: 5,244,313

[45] Date of Patent: Sep. 14, 1993

[54] RATCHETING SEGMENTS FOR TLP CONNECTOR

[75] Inventors: Joseph W. Pallini, Tomball; Rockford D. Lyle, Houston, both of Tex.

[73] Assignee: ABB Vetco Gray Inc., Houston, Tex.

[21] Appl. No.: 902,115

[22] Filed: Jun. 19, 1992

[51] Int. Cl.[5] ..... E02B 17/06

[52] U.S. Cl. ..... 405/223.1

[58] Field of Search ..... 405/195.1, 224, 223.1, 405/204; 403/369; 166/349, 341, 339, 338, 365; 285/317; 114/294, 297

[56] References Cited

U.S. PATENT DOCUMENTS

| | | | |
|---|---|---|---|
| 3,058,386 | 10/1962 | Morrow | 403/369 X |
| 3,321,217 | 5/1967 | Ahlstone | 166/338 |
| 3,957,381 | 5/1976 | Schafer | 403/369 X |
| 4,611,953 | 9/1986 | Owens | 405/224 |
| 4,699,215 | 10/1987 | Cuiper | 166/341 |
| 4,869,615 | 9/1989 | Galle | 405/224 X |
| 4,871,282 | 10/1989 | Jennings | 405/224 |
| 5,020,942 | 6/1991 | Pallini | 405/224 |

*Primary Examiner*—Dennis L. Taylor
*Attorney, Agent, or Firm*—James E. Bradley

[57] ABSTRACT

A tension leg platform utilizes a top connector for the tendons that has ratcheting segments. Each segment includes a carrier located above and a lower portion containing grooves for engaging the upper end of the tendon. Springs locate between the carrier and the segments. An actuator will move the carriers downward from an upper position to a lower position. The springs allow ratcheting axial movement between the segments and the carriers. The ratcheting movement occurs as the housing moves downward relative to the tendons.

16 Claims, 3 Drawing Sheets

RATCHETING SEGMENTS FOR TLP CONNECTOR

BACKGROUND OF THE INVENTION

1. Field of the Invention

This invention relates in general to tension leg platforms for offshore drilling, and in particular to a top connector for connecting the upper end of a tendon to the platform.

2. Description of the Prior Art

A TLP or tension leg platform is a type of offshore drilling and production structure. The platform floats and is secured to the sea floor by tendons. The tendons are large pipes, about 20 to 45 inches in diameter. After securing the tendons to the platform and to the sea floor, ballast water is pumped out to cause the platform to rise. This is resisted by the tendons, placing the tendons under tension load. The tendons under tension provide a stable platform for drilling and oil production.

U.S. Pat. No. 4,871,282, Charles E. Jennings, Oct. 3, 1989 and U.S. Pat. No. 5,020,942, Joseph W. Pallini, Jr., Jun. 4, 1991, describe top connectors for connecting the top of the tendon to the platform. In the devices shown in these patents, the upper end of the tendon has helical threads. The threaded section extends through a housing which has a conical bore. Segments, or dogs, will slide down the conical bore from a retracted position to an engaged position. The segments having mating threads which will engage the threads on the tendon. A cam ring causes the downward movement of the segments. The cam ring will also rotate the segments once in contact with the tendon to mesh the threads of the segments with the threads of the tendon.

While the devices of these patents are workable for certain platforms, disadvantages exist for some very large tension leg platforms. In one large platform being proposed, there will be no tendon tensioning, motion compensator or arresting devices.

The platform is large enough that relative motion between the platform and the tendons is small and slow. For this reason, the tendon handling system will support only the weight of the tendon plus a slight overpull.

In that system, the top connector will be required to dynamically lock off the platform to the tendon and also to accommodate upward relative motion of the tendon during downward movement of a platform. Trim adjustments must also be made over a period of several hours while the platform is adding ballast. The platform will move down relative to the tendons during the ballasting procedure. This requires that the segments be rotated to tighten the engaged segments during the ballasting procedure.

The rotation would be at a much higher speed than used with the configuration shown in the abovementioned patents. Also, this rotation would have to be performed over several hours. This would require a hydraulic system much more powerful than previously employed. Moreover, all of the top connectors must be actuated at the same time, rather than one per column as in the prior art tension leg platforms.

SUMMARY OF THE INVENTION

In this invention, rather than rotating the engaged segments to tighten as the tendons move upward relative to the housing, a ratcheting device is employed. The ratcheting device allows the segments to ratchet as the platform moves downward relative to the tendons. The threads or grooves on the segments will engage the tendon threads during the ratcheting action to prevent upward movement of the platform relative to the tendons, but will allow downward movement.

The ratcheting device comprises splitting each segment into two portions, an upper carrier portion and a lower engaging portion. The carrier and the segment are axially separated from each other. Springs mounted between the carrier and the segment allow axial movement of the segment relative to the carrier to allow the segment to ratchet. The actuator, which is a cam ring, engages the carrier and moves it downward, causing the segments to move downward from the retracted position to the engaged position. Guides are employed to maintain axial and radial alignment of the segments during the downward movement on the housing conical shoulder, and during ratcheting action.

DETAILED DESCRIPTION OF THE INVENTION

Figure 1:
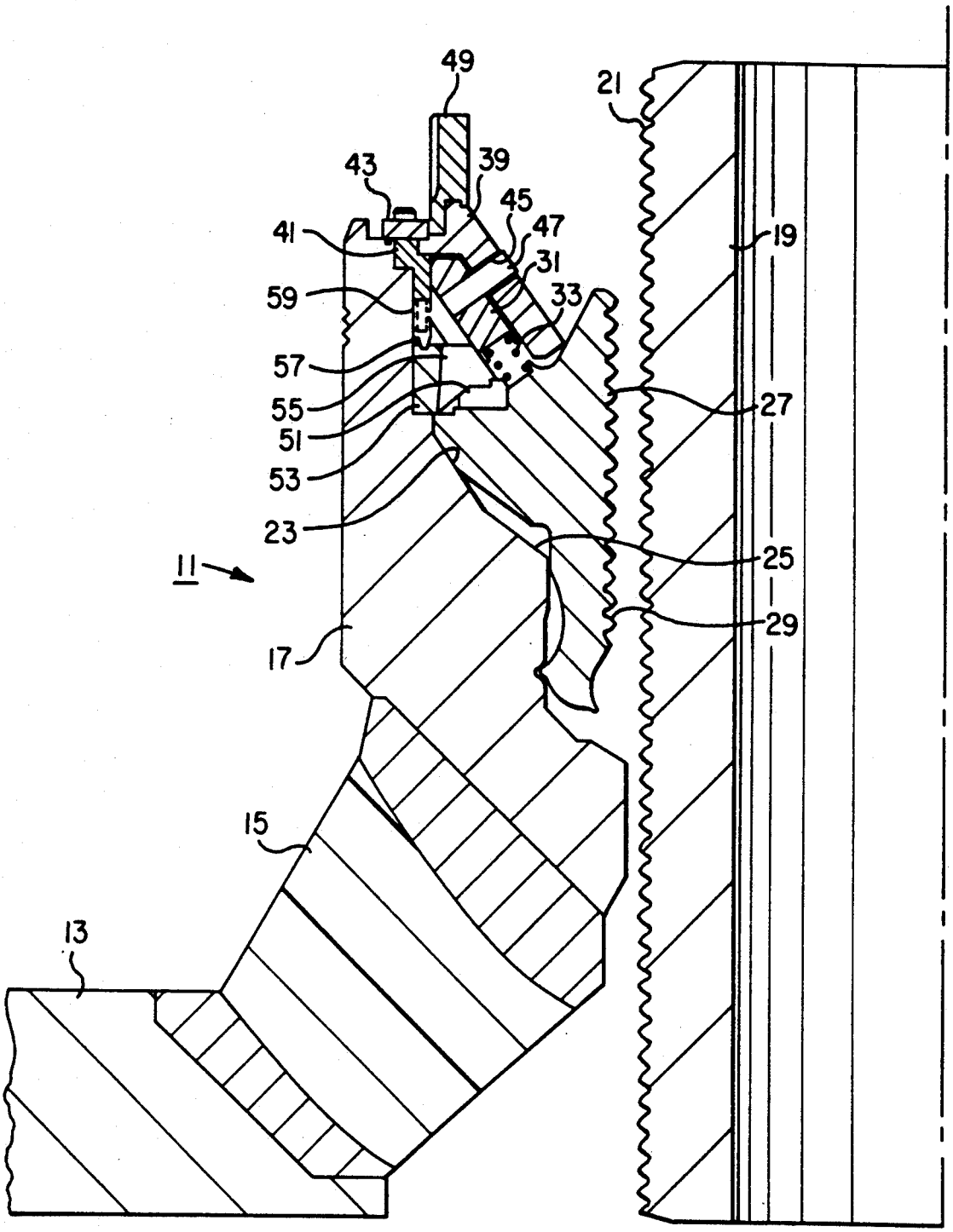
FIG. 1 is a vertical sectional view of a top connector for a tension leg platform, constructed in accordance with this invention and shown in a retracted position.

Referring to FIG. 1, top connector 11 will be mounted to a tension leg platform (not shown) at the bottom of a column of the platform. Top connector 11 includes a base 13 that mounts to the platform. A flexible element 15 is mounted to base 13. A flexible element 15 is a combination of thermoplastic elastomic with metal plates. A housing 17 secures to the flexible element 15. The flexible element 15 allows housing 17 to twist and move angularly with wave movement.

The upper end of a tendon 19 extends upward through housing 17. The upper end of tendon 19, also called a terminal segment, has a plurality of grooves on its exterior, preferably helical threads 21. Housing 17 has an axial bore with two frusto-conical shoulders 23, 25. Shoulders 23, 25 incline relative to the vertical axis of housing 17.

Six separate dogs or segments 27 are carried on the shoulders 23, 25. The segments make up a split nut which will secure to the external threads 21 of tendon 19. As shown also in FIG. 2, each segment 27 has conical surfaces that slidingly mate with the shoulders 23, 25. Each segment 27 has internal grooves or threads 29 that are formed to mate with threads 21 on tendon 19. Segments 27 will slide between an upper retracted position, shown in FIG. 1, to a lower position, shown in FIG. 2. In the lower position, the threads 29 will ratchet and engage the tendon threads 21.

Each segment 27 has an upper portion, referred to as a carrier 31. Each carrier 31 is also a segment, separated by clearances from adjacent carriers. Each carrier 31 connects to one of the segments 27 by means of a plurality of coil springs 33. Springs 33 serve as spring means to allow the segments 27 to move axially and ratchet relative to carrier 31.

Figure 2:
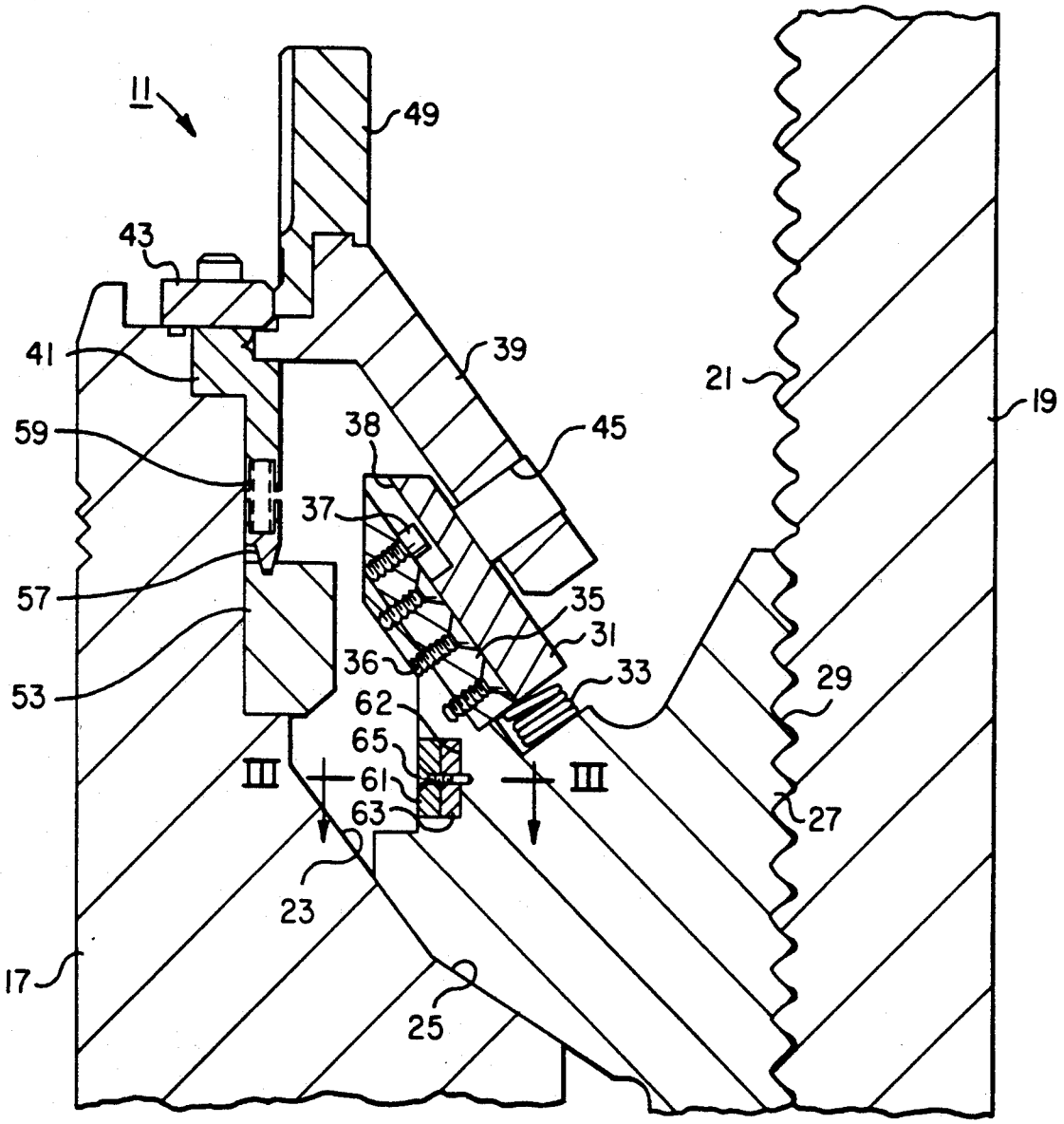
FIG. 2 is an enlarged, partial sectional view of the top connector of FIG. 1, showing the segments in an engaged position and taken along a different section line than in FIG. 1.

As shown in FIG. 2, a pair of guide rails 35 (only one shown) are secured to each segment 27 by fasteners 36. Each guide rail 35 extends upward and outward from the segment 27, extending slidingly into channels in the carriers 31. Guide rails 35 maintain alignment of the carrier 31 with the segment 27, but allow relative axial movement to occur between the segment 27 and carrier 31. A cap screw 37 for each guide rail 35 locates in a recess 38 in the back side of each carrier 31 to provide a maximum extension or gap between the carrier 31 and the segment 27. Cap screw 37 contacts an upward facing shoulder of recess 38 when carrier 31 is pulled upward to lift the segment 27 to a retracted position.

Referring again to FIG. 1, a cam ring 39 serves as actuating means for moving the segments 27 between the upper and lower positions. Cam ring 39 has an external flange carried in a groove which is defined by a support ring 41 and a retaining ring 43. Support ring 41 and retaining ring 43 are mounted rigidly to housing 17. Cam ring 39 is rotatable relative to housing 17.

Cam ring 39 has a plurality of cam slots 45 formed therein. Cam slots 45 are shown more clearly in U.S. Pat. No. 4,871,282, Charles E. Jennings, Oct. 3, 1989 and U.S. Pat. No. 5,020,942, Joseph W. Pallini, Jr., Jun. 4, 1991, all of which material is hereby incorporated by reference. Cam slot 45 extends circumferentially and also inclines downward a selected distance. A pin 47 for each of the cam slots 45 is fixed to each of the carriers 31. Pins 47 and cam slots 45 cause the carriers 31 to move downward as the cam ring 39 rotates in one direction. This axial movement occurs as a result of pin 47 moving downward relative to housing 17 as it moves from an upper end to a lower end of cam slot 45. A drive ring 49 mounted to cam ring 39 will receive a hydraulically-powered tool (not shown) for causing rotation of cam ring 39.

Each of the segments 27 has an axially extending slot 51 formed on its outer surface or side. Slot 51 is located in the center of each segment 27. A guide ring 53 locates radially outward from slots 51. Guide ring 53 is carried for sliding movement on a shoulder located in the bore of housing 17. Guide ring 53 has a plurality of circumferentially spaced apart fingers 55. Fingers 55 and slots 51 are not shown in FIG. 2 because of the different sectional view presented. Each finger 55 extends radially inward from an inner side of guide ring 53 and slidingly engages one of the slots 51. The fingers 55 and slots 51 will allow the segments 27 to move axially relative to guide ring 53. However, fingers 55 and slots 51 will not allow any rotational movement of any of the segments 27 relative to guide ring 53. This keeps the circumferential clearances between each of the segments 27 even as the segments 27 slide downward and inward on the conical shoulders 23, 25.

The device also has means for applying a frictional force to guide ring 53 to cause it to resist rotation until the pin 47 has reached the lower end of cam slot 45. This means prevents the carriers 31 and segments 27 from rotating with the cam ring 39 until the segments 27 have moved to a lower engaged position. In the preferred embodiment, this comprises a clutch ring 57. Clutch ring 57 is an annular member mounted on top of the guide ring 53. Clutch ring 57 engages grooves formed in the upper side of guide ring 53. Springs 59 apply a downward force to the clutch ring 57. Springs 59 are coil springs compressed between clutch ring 57 and fixed support ring 41. Clutch ring 57 will not rotate at any time.

Figure 3:
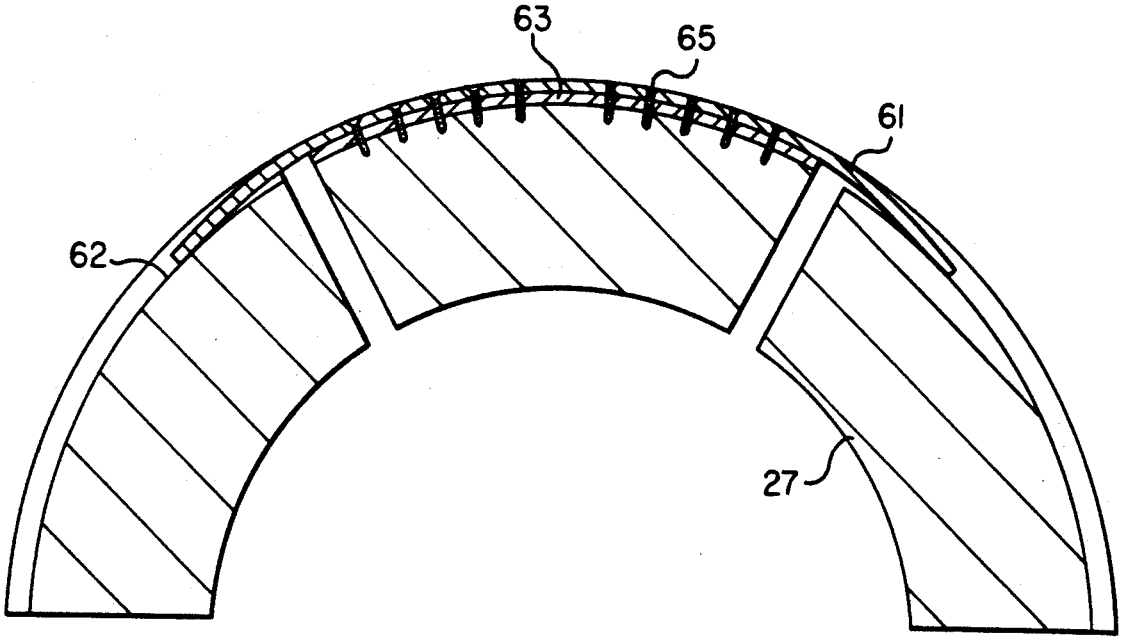
FIG. 3 is a sectional view of a portion of the top connector of FIG. 1, taken along the line III—III of FIG. 2, and showing the segments in a retracted position.

Referring to FIGS. 2 and 3, a pair of curved bands 61 (only one shown) are employed to assure that the segments 27 move downward at the same rate. Each band 61 mounts to a spacer 63 and is secured by fasteners 65 to one of the segment 27. Each band 61 is located in a recess 62 formed in the outer side of each of the segments 27. Band 61 has free ends that extend over into the recess 62 of an adjacent segment 27 on each side. The free ends are not secured to the adjacent segments 27, rather slide relative to the adjacent segments 27 as the segments 27 move closer toward each other while sliding downward on the conical shoulders 23, 25 of housing 17 (FIG. 1). Bands 61 do not flex and will accommodate the clearances between the segments 27 decreasing as the segments 27 move down the conical shoulders 23, 25 of housing 17 (FIG. 1). The free ends, being located in the enclosed recesses 62, cause all three segments 27 to move downward at the same rate. A similar band 61 (not shown) will be located on a segment 180 degrees from the segment 27 shown in FIG. 3.

In operation, the ballasting procedure will cause the platform and housing 17 to move downward relative to tendon 19. A hydraulic tool will rotate cam ring 39 a short distance. The interaction between pin 47 and cam slot 45 causes each carrier 31 to move downward from the position shown in FIG. 1 to the position shown in FIG. 2. At the same time, the segments 27 will move downward on the shoulders 23, 25. The threads 29 will engage the threads 21. The segments 27 will ratchet over the threads 21 when the housing 17 moves downward relative to tendon 19. Each time a new helix of threads 21 is passed, the segments 27 will slide back in and re-engage the threads 21. Each ratcheting movement of segments 27 will result in upward movement of segments 27 relative to carriers 31, compressing springs 59.

Eventually, the operator will remove some of the ballast from the platform to apply tension to the tendons 19. The engagement of segments 27 with threads 21 will prevent any upward movement of housing 17 relative to the tendon 19. Fine adjustments in tension in the tendons 19 can be made by rotation of the cam ring 39, which in turn rotates to segments 27 to tighten the engagement of threads 21 and 29.

The invention has significant advantages. The two-piece segments, with springs located between the carrier portion and segment portion, allows ratcheting of the segments during the ballasting procedure. The carriers, being forced down by the actuating means, assure that the segments move down into ratcheting engagement. The bands assure that the segments are in the same axial position relative to each other, which allows the slips to move freely, but keeps them axially aligned.

While the invention has been shown in only one of its forms, it should be apparent to those skilled in the art that it is not so limited, but is susceptible to various changes without departing from the scope of the invention.

We claim:

1. In a floating platform having a plurality of tendons, each extending in tension from the sea floor through an axial bore of a housing carried by the platform, the bore having a conical shoulder which carries a plurality of segments having interior grooves for engaging exterior grooves formed on each tendon, an improved means for moving each of the segments from an upper retracted position down the conical shoulder to a lower position in contact with the grooves on the tendon, comprising in combination:

a plurality of segment carriers located in the bore of the housing, each located above one of the segments;

actuator means for moving each of the segment carriers from an upper position to a lower position; and ratchet means mounted between each of the segment carriers and one of the segments for retaining each of the segments in the upper position while the segment carriers are in the upper position, for causing each of the segments to move downward on the conical shoulder to the lower position in contact with the grooves on the tendon as the segment carriers are moved downward by the actuator means, and for allowing relative axial movement between each of the segment carriers and each of the segments while the segments are in the lower position, to enable ratcheting of each of the segments on the grooves of the tendon to occur as the tendon moves upward relative to the housing.

2. The floating platform according to claim 1 wherein the ratchet means comprises a plurality of coil springs secured between each of the segment carriers and each of the segments.

3. The floating platform according to claim 1 further comprising:

retainer means for causing all of the segments to move downward simultaneously as the actuator means moves the segment carriers downward.

4. The floating platform according to claim 1 further comprising:

a plurality of curved bands, each secured to at least one of the segments and extending slidingly into contact with at least one of the other segments, for causing said other of the segments to move downward simultaneously with the segment to which the band is secured.

5. The floating platform according to claim 1 wherein the ratchet means includes guide rail means extending between each of the carriers and each of the segments for maintaining axial alignment of each of the segments relative to one of the carriers.

6. The floating platform according to claim 1 wherein the ratchet means includes a pair of guide rails for each segment, each extending between one of the carriers and one of the segments for maintaining axial alignment of each of the segments relative to one of the carriers.

7. The floating platform according to claim 1 wherein:

the grooves on the tendons are threads;

the grooves on the segments are threads; and the actuator means is capable of rotating the segment carriers and segments in unison while the segments are in the lower position to mesh the threads of the segments with the threads of the tendons.

8. In a floating platform having a plurality of tendons, each extending in tension from the sea floor through an axial bore of a housing carried by the platform, the bore having a conical shoulder which carries a plurality of segments having interior threads for engaging exterior threads formed on each tendon, an improved means for moving each of the segments from an upper retracted position down the conical shoulder to a lower position in contact with the threads on the tendon, comprising in combination:

a plurality of segment carriers located in the bore of the housing, each located above one of the segments, each of the segment carriers having an upward facing inclined surface;

a cam ring mounted rotatably to the housing above the segments, the cam ring having an downward facing inclined surface that overlies the inclined surface of each of the segment carriers;

pin and slot means, including an inclined guide slot located in one of the inclined surfaces and a pin protruding from the other of the inclined surfaces and engaging the guide slot, for causing each segment carrier to move from an upper position to a lower position when the cam ring is rotated in relative to the segment carrier;

ratchet means mounted between each of the segment carriers and one of the segments for retaining each of the segments in the upper position while the segment carriers are in the upper position, for causing each of the segments to move downward on the conical shoulder to the lower position in contact with the threads on the tendon as the segment carriers are moved downward by the pin and slot means, and for allowing relative axial movement between each of the segment carriers and each of the segments while the segments are in the lower position, to enable ratcheting of each of the segments on the threads of the tendon to occur as the tendon moves upward relative to the housing; and the segments being rotatable in unison with the cam ring relative to the tendon by continued rotation of the cam ring after the segments are in the lower position, to mesh the threads of the segments with the threads of the tendon.

9. The floating platform according to claim 8 wherein the ratchet means comprises a plurality of coil springs secured between each of the segment carriers and each of the segments.

10. The floating platform according to claim 8 further comprising:

retainer means for causing all of the segments to move downward simultaneously as the actuator means moves the segment carriers downward.

11. The floating platform according to claim 8 further comprising:

a recess on each of the segments;

a plurality of curved bands, each secured to the recess of at least one of the segments and extending slidingly into contact with at least one of the recesses of one of the other segments, for causing both of the segments to move downward simultaneously as the actuator means moves the segment carriers downward.

12. The floating platform according to claim 8 wherein the ratchet means includes guide rail means extending between each of the carriers and each of the segments for maintaining axial alignment of each of the segments relative to one of the carriers.

13. The floating platform according to claim 8 wherein the ratchet means includes a pair of guide rails for each segment, each extending between one of the carriers and one of the segments, each of the guide rails being secured to one of the segments and carriers and slidable relative to the other of the segments and carriers for maintaining axial alignment of each of the segments relative to one of the carriers.

14. A top connector for a tendon of a floating platform, the tendon extending in tension from the sea floor and having external grooves, comprising in combination:

a housing carried by the platform, the housing having an axial bore having a conical shoulder, the tendon extending through the bore;

a plurality of segments having interior grooves for engaging the grooves formed on each tendon, each of the segments being movable from an upper retracted position down the conical shoulder to a lower position in contact with the grooves on the tendon;

a plurality of segment carriers located in the bore of the housing, each located above one of the segments, each of the segment carriers having an upward facing inclined surface;

actuator means for moving each of the segment carriers from an upper position to a lower position; and means, including a plurality of coil springs mounted between each of the segment carriers and one of the segments, for retaining each of the segments in the upper position while the segment carriers are in the upper position, for causing each of the segments to move downward on the conical shoulder to the lower position in contact with the grooves on the tendon as the segment carriers are moved downward by the pin and slot means, and for allowing relative axial movement between each of the segment carriers and each of the segments while the segments are in the lower position, to enable ratcheting of each of the segments on the grooves of the tendon to occur as the tendon moves upward relative to the housing;

retainer means for causing all of the segments to move downward simultaneously as the actuator means moves the segment carriers downward; and guide rail means extending between each of the carriers and each of the segments for maintaining axial alignment of each of the segments relative to one of the carriers.

15. The top connector according to claim 14 wherein the retainer means comprises:

a recess on each of the segments;

a plurality of curved bands, each secured to the recess of at least one of the segments and extending slidingly into the recess of at least one of the other segments.

16. The top connector according to claim 14 wherein the guide rail means comprises:

a pair of guide rails for each segment, each extending between one of the carriers and one of the segments, each of the guide rails being secured to one of the segments and carriers and slidable relative to the other of the segments and carriers for maintaining axial alignment of each of the segments relative to one of the carriers.

* * * * *